US005115795A

United States Patent [19]

Farris

[11] Patent Number: 5,115,795

[45] Date of Patent: May 26, 1992

[54] CROSSBOW COCKING DEVICE

[76] Inventor: William M. Farris, Rt. #4, Box 198A, Booneville, Ark. 72927

[21] Appl. No.: 568,134

[22] Filed: Aug. 16, 1990

[51] Int. Cl.[5] ..... F41B 5/00

[52] U.S. Cl. ..... 124/86; 124/25

[58] Field of Search ..... 124/17, 20.1, 20.3, 124/21, 22, 25, 25.5, 27, 28, 29, 86, 88

[56] References Cited

U.S. PATENT DOCUMENTS

| | | | |
|---|---|---|---|
| 2,092,361 | 9/1937 | Shirn | 124/25 |
| 2,523,805 | 9/1950 | Anthony | 124/29 X |
| 2,638,885 | 5/1953 | Keadle | 124/20.1 |
| 2,645,218 | 7/1953 | Fischer | 124/21 |
| 3,043,287 | 7/1962 | Nelson . | |
| 3,670,711 | 6/1972 | Firestone | 124/25 |
| 3,783,852 | 1/1974 | Shepherd | 124/22 |
| 4,719,897 | 1/1988 | Gaudreau | 124/25 |
| 4,766,874 | 8/1988 | Nishioka | 124/25 |
| 4,827,894 | 5/1989 | Schallberger | 124/25 |
| 4,942,861 | 7/1990 | Bozek | 124/25 |

*Primary Examiner*—Peter M. Cuomo
*Assistant Examiner*—John A. Ricci
*Attorney, Agent, or Firm*—Hoffman, Wasson & Gitler

[57] ABSTRACT

A floor standing, easily operated crossbow cocking mechanism for cocking an archery crossbow, incorporating a main structural frame member, a stable base member for contacting the floor, a hook for securing a crossbow body to the upper part of the frame member, a slidable carriage mounted for movement along the structural member and a pair of spaced apart fingers for engaging the string of the crossbow, so that the string can be drawn back by a force multiplying assembly, such as a winch and racket mechanism. Once cocked, the crossbow can be removed from the cocking mechanism and be employed for game hunting, for target practice, or for whatever purpose the user deems appropriate.

5 Claims, 2 Drawing Sheets

CROSSBOW COCKING DEVICE

BACKGROUND

1. Field of the Invention

This invention relates to the field of archery, and more particularly to a device for cocking a crossbow.

2. Description of the Prior Art

Crossbows in general have a very high drawing force—on the order of hundreds of pounds—that make them impossible to cock without force-multiplying tools.

Numerous force-multiplying devices are known, operating on the principle of levers or toggles, for enabling one to cock a crossbow. Such devices typically attach, temporarily, to the stock of the weapon, and are removed once the bow is cocked. Even with such devices, cocking can be difficult, and a particular cocking implement may not be useful for bows of substantially different sizes. In addition, such mechanical devices put the user in the vicinity of the bow while cocking, creating risk to him in the event of slippage or breakage of the device of the crossbow.

In view of the foregoing, it is an object of the invention to provide archers with a universal crossbow cocking apparatus, useful on bows of different designs, sizes and strengths.

Another object is to avoid reliance on mechanical force-multiplying mechanisms, and to enable the user to get a safe distance away from the crossbow while it is being cocked. A related object is to greatly increase the force multiplication ratio of such a device, and to enable the work of cocking to be done by a small motor, if desired.

SUMMARY OF THE INVENTION

In view of the foregoing, a crossbow cocking apparatus embodying the invention comprises a frame including a vertical structural member, a base at the lower end of the structural base member, means for holding a stationary portion of a crossbow, a carriage mounted for sliding movement along said vertical member, means on said carriage for engaging the string of the crossbow, and force multiplying means for moving said carriage along said vertical member to draw said string to a cocked position.

DESCRIPTION OF THE DRAWINGS

An apparatus embodying the invention is depicted in the accompanying drawings, wherein.

DESCRIPTION OF THE PREFERRED EMBODIMENT

Figure 1:
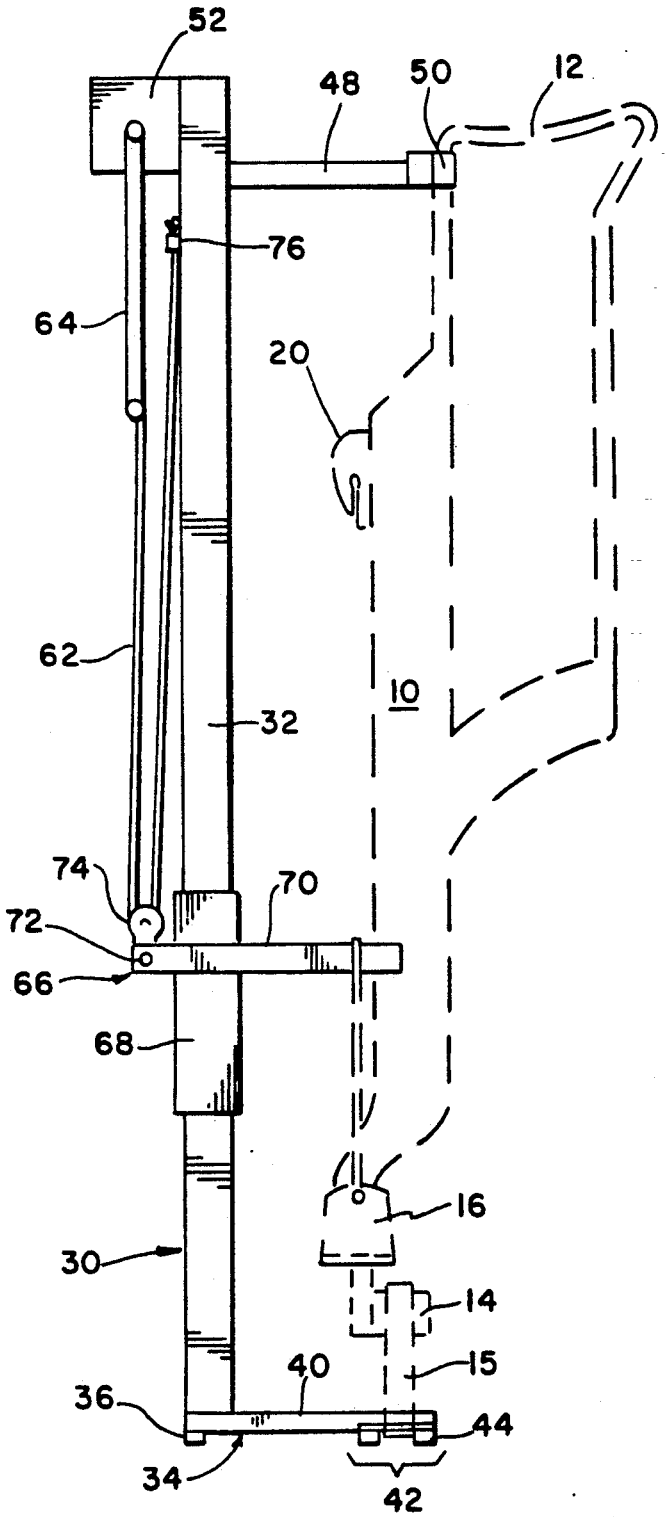
FIG. 1 is a side elevation thereof.
Figure 3:
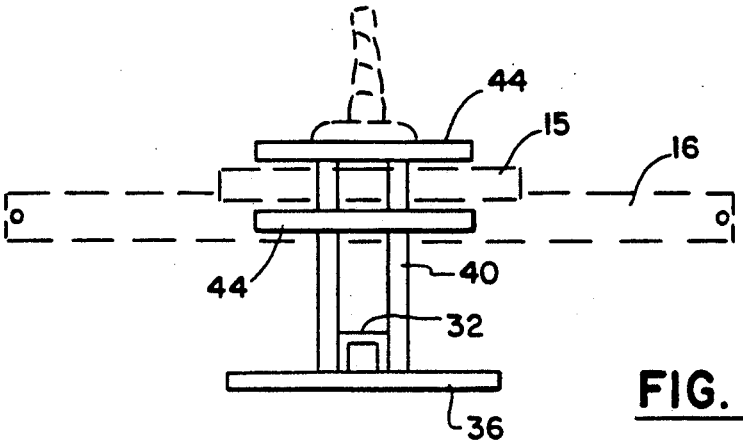
FIG. 3 is a top plan view thereof.

In FIGS. 1 and 3, a crossbow, which does not itself form part of the invention, is shown in phantom lines. The major parts of the crossbow, for future reference, are the stock or main beam 10, having an integral arm butt 12 at one end, and an anchor 14 at the other end, which provides a retention point for the cocking apparatus. The bow 16 is affixed to the stock adjacent the anchor, and a string or cable 18 extends between the ends of the bow. The bow may be of the simple or compound type; the nature of the bow does not affect the invention. A latch 20 receives the string when it is draw back sufficiently, and holds it in position until release by pulling a trigger (not shown) extending from the opposite side of the stock.

Figure 2:
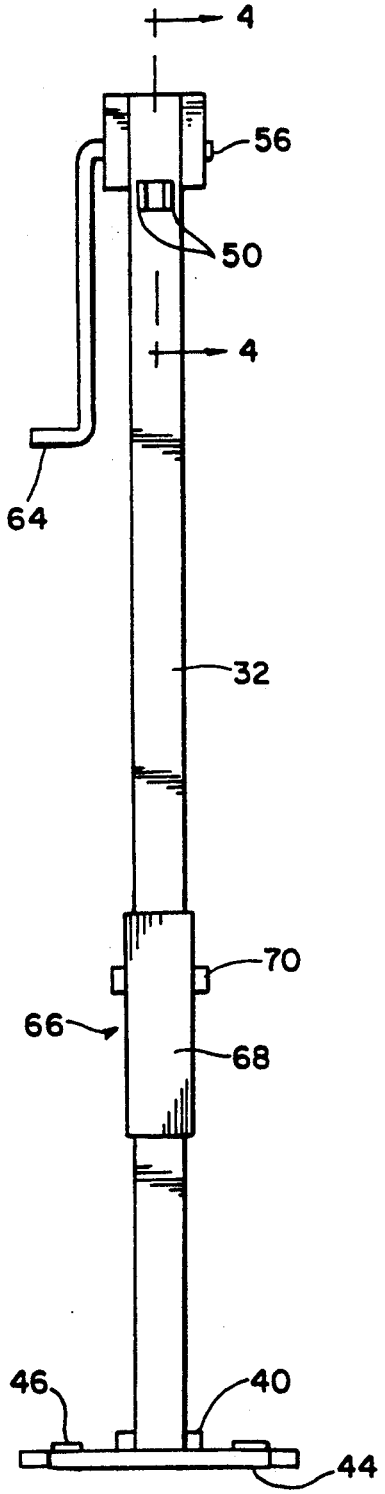
FIG. 2 is a front elevation thereof.

As shown in FIGS. 1, 2 and 3, the cocking apparatus includes a frame, designated generally by numeral 30, which includes a structural steel member 32, of vertical cross-section, about as long as the crossbow. The device can be used in different orientations, but is shown in the drawings with the structural member 32 vertical, and this frame of reference is used throughout the specification without any intention of limiting the invention to that orientation.

A base 34 is welded to the bottom end of the vertical member 32. This base comprises a transverse brace 36 welded across the bottom of the vertical member 32, a pair of spaced feet 40 connected to opposite sides of the vertical member, and a bracket 42 extending parallel to the transverse brace 36, and connected across the ends of the feet. The bracket 42 is made from a pair of parallel elements 44, welded to the feet 40, and a pair of small metal plates 46 welded across the elements 44 outboard of the feet 40.

Near the opposite (top) end of the vertical member, there is a stock stabilizer comprising an arm 48 welded to the member, and extending forwardly therefrom, parallel to the feet 40. The arm has a pair of spaced tabs 50 at its forward end, with a space therebetween for receiving a portion of the armbutt of the crossbow. A winch bracket 52 is connected to the rear of the vertical member, also at its top, by welding.

Figure 4:
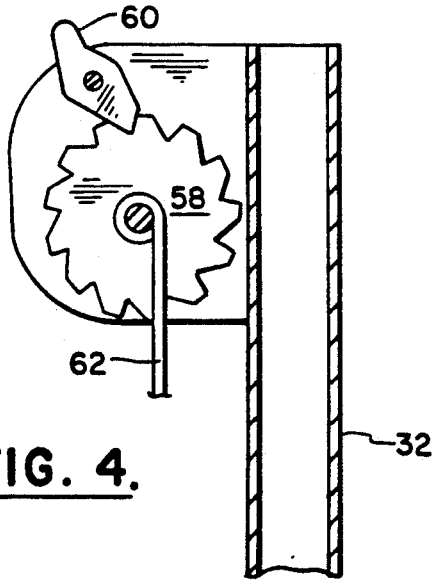
FIG. 4 is a sectional view taken along the line 4—4 in FIG. 2.

As shown in FIG. 4, the bracket includes a pair of spaced plates 54 with a shaft 56 extending through holes in the plates. A starwheel 58 is affixed to the shaft, engaged by a pawl 60 pivotally mounted on one of the plates 54. The shaft functions as a winding drum for a cord or cable 62 whose end is fastened to the shaft, while the starwheel and pawl prevent unintentional unwinding. One end of the shaft is bent to form a Z-shaped handle 64 by which one can turn the shaft and thereby draw in the cord.

A carriage 66 is mounted for sliding movement along the vertical member. The carriage includes a hollow structural square tube 68 slidably mounted on the vertical member, and is retained thereon by the base at one end and the arm at the other end. Connected across the square tube 68 are a pair of fingers 70 that extend in the direction of, and parallel to the feet 40. These fingers engage the string of the bow as the carriage is moved upwardly along the vertical member.

The fingers 70 extend slightly to the rear of the square tube, affording a mounting 72 for a pulley 74. The free end of the cord 62 is passed around the pulley, and runs back to an anchor point 76 on the vertical member, just below the winch.

In operation, a crossbow is mounted in the apparatus by passing its anchor strap 15 under the feet 40, and between the elements 44. The armbutt of the crossbow is placed between the tabs 50, and the carriage is brought to a position so that the fingers engage the bow string from below. Now, with the bow safely anchored in the apparatus, one need only turn the winch handle to move the carriage, and thus draw back the bow string to its cocked position. Once the string is latched in the bow, the winch can be released, and the bow removed from the apparatus.

The cocking operation, with this invention, is characterized by the absence of any need for the archer to contact, or be near, the bow while cocking it, so that if there is a mechanical failure, his chance of injury is greatly reduced. In addition, the mechanical advantage of the device is easily changeable, for example by changing the length of the handle, the diameter of the shaft, or the pulley arrangement.

Figure 5:
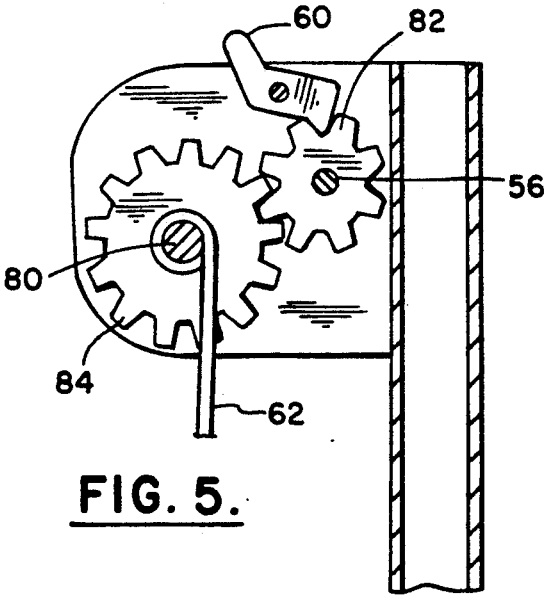
FIG. 5 is a view corresponding to FIG. 4, showing a modified form of the invention.

FIG. 5 shows a variation of the invention in which the rope 62 is wound on a winch shaft 80, rather than directly on the handle shaft 56. A small gear 82, mounted on the handle shaft, and a larger gear 84, mounted on the winch shaft, provide added mechanical advantage.

The invention is subject to other variations and changes in detail. For example, other force multiplying devices, such as hydraulic cylinders, could replace the winch and pulley arrangement. Changes in size, proportion and material could be made to accommodate different bows and user requirements. Since the invention is subject to these and other changes, it is intended that the foregoing be regarded as only illustrative of the invention described by the following claims.

I claim:

1. A force multiplying apparatus for cocking a crossbow which is separable from the apparatus, the apparatus comprising: a main structural member including securing means adapted to retain a crossbow in a fixed position; a carriage slidably mounted upon the main structural member for engaging the bowstring of the crossbow; a pulley anchored to said carriage; a cord passing over said pulley, one end of said cord being attached to the main structural member and the other end of the cord being wound upon a winch affixed to the main structural member; a pawl and ratchet mechanism associated with said winch; and a means for rotating said winch, whereby operation of said winch rotating means draws said cord so as to move the carriage along the main structural member, thereby drawing the bowstring to a cocked position.

2. The invention o claim 1, wherein the crossbow securing means, comprises: a base at one end of the main structural member adapted to receive a strap extending between an anchor on a crossbow, and said base to secure the crossbow relative to said base and extending substantially parallel to said main structural member.

3. An apparatus for cocking a crossbow, said apparatus comprising:

a) a base (34), b) an elongated member (32) extending upwardly from, and perpendicular to, said base, c) an arm (48) having a rear end and free end, said rear end secured to the upper end of said elongated member and extending perpendicular thereto and parallel to said base, d) tabs (50) situated at the free end of said arm and adapted to receive the arm butt (12) of a crossbow, e) means (44) on said base adapted to receive a strap (15) extending between an anchor (14) on the crossbow and said base to secure the crossbow relative to said base and substantially parallel to said elongated member, f) a tube (68) slidably mounted on said elongated member for movement therealong, g) fingers (70) on said tube extending parallel to said arm, said fingers adapted to engage the string (18) of a crossbow, and h) a bracket (52) secured to the upper end of said elongated member, and i) force multiplying means secured between said bracket and said fingers for shifting said tube along said vertical member until the bowstring is fully cocked.

4. An apparatus for cocking a crossbow, said apparatus being separate and distinct from the crossbow, and comprising:

a) a stable base (34), b) an elongated member (30, 32) extending upwardly from said base (34) for a distance approximating the length of a crossbow, c) stabilizers (48, 50) located at the upper end of said elongated member (30, 32) adapted to receive the stock of a crossbow therebetween, d) securement means (15) passing about said base (34) and extending upwardly from said base (34) and adapted to pass around an anchor (14) of a crossbow retained within the stabilizers (48, 50), e) a tube (68) slidably mounted on said elongated member (30, 32) for movement therealong, f) fingers (70) projecting parallel to said stabilizers (48, 50), said fingers (70) adapted to engage the string of a crossbow, g) a bracket (52) secured to the upper end of said elongated member, and h) force multiplying means secured between said bracket and said fingers (70) for shifting said tube (68) along said elongated member (30, 32) until the bowstring of a crossbow is fully cocked.

5. The invention of claim 4, comprising two fingers extending from the tube (68) adapted to engage the string of a crossbow on either side of the bow stock.

* * * * *